United States Patent [19]

Mochizuki et al.

[11] Patent Number: 4,662,607

[45] Date of Patent: May 5, 1987

[54] APPARATUS FOR OPERATING MANHOLE COVER

[75] Inventors: Otohiko Mochizuki; Susumu Mochizuki, both of Shizuoka, Japan

[73] Assignee: Mochizuki Motor Co. Ltd., Japan

[21] Appl. No.: 806,094

[22] Filed: Dec. 6, 1985

[30] Foreign Application Priority Data

Dec. 7, 1984 [JP] Japan ..... 59-258799

[51] Int. Cl.[4] ..... B66F 11/00

[52] U.S. Cl. ..... 254/131

[58] Field of Search ..... 414/684.3; 280/47.27; 294/15, 17, 91; 254/120–123, 131.5, 131, 132, 129

[56] References Cited

U.S. PATENT DOCUMENTS 4,126,297 11/1978 Barnes ..... 254/131
4,250,769 2/1981 Herring ..... 254/129
4,365,925 12/1982 Girtz ..... 254/131

*Primary Examiner*—Robert C. Watson
*Attorney, Agent, or Firm*—Steinberg & Raskin

[57] ABSTRACT

An apparatus for operating a manhole cover is disclosed which is capable of being applied to an operating hole of any type and accomplishing not only the separation of an edge of a manhole cover from a manhole but the lifting and movement of the manhole cover from the manhole. The apparatus includes a lever-like body and a hanging hook mechanism pivotally connected to a pivot point defined on the point of application side of the lever-like body. The hanging hook mechanism comprises a rod-like insertion member which is adapted to be inserted in an operating hole of a manhole cover and has a projection provided on a lower end thereof to be directed toward the pivot point and adapted to be firmly engaged with an operating hole. The pivot point is eccentric to the longitudinal direction of the insertion member. Also, a point of support on the lever-like body is defined at each of two positions on the lever-like body between a point of application and a point of force.

13 Claims, 17 Drawing Figures

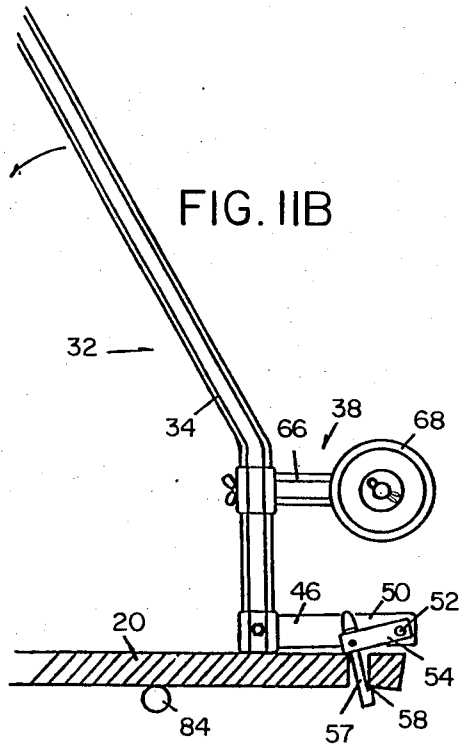
FIG. IIB
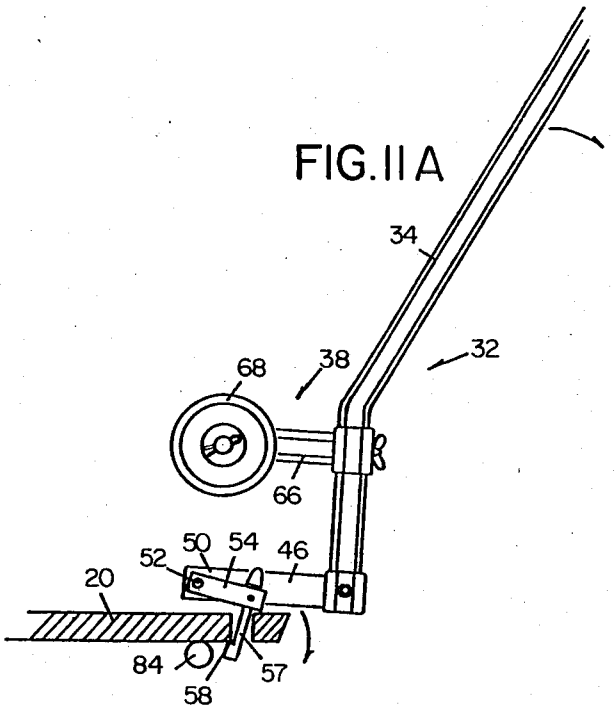
FIG. IIA

APPARATUS FOR OPERATING MANHOLE COVER

BACKGROUND OF THE INVENTION

1. Field of the Invention

This invention relates to an apparatus for operating a cover for a manhole for operating and inspecting piping, a tank or the like which is laid under the ground, and more particularly to a novel apparatus for operating a manhole cover which is effectively applicable to a manhole cover of any shape and adapted to readily carry out both the separation of an edge of a manhole cover securely adhered to a support frame of a manhole therefrom and the subsequent lifting and movement of the cover from the manhole.

2. Description of the Prior Art

In general, a manhole cover is provided with various types of holes for operating the cover depending upon the type of manhole. Also, a manhole cover generally has a large weight and is fitted in a support frame of a manhole in a state of being adherently fixed therein by means of sand, mud or the like entering between the cover and the support frame. Accordingly, in order to operate an manhole cover, it is initially required carry out the separation of an edge of the manhole cover from a support frame of a manhole which is generally referred to as "edge separating operation" in the art, prior to the opening of the manhole cover. Such edge separating operation renders the operation of a manhole cover highly troublesome.

More particularly, a manhole cover, as shown in FIG. 1, is provided with various types of operating holes depending upon the type of a manhole cover. In FIG. 1, reference numeral 20 designates a manhole cover and 22*a* to 22*f* indicate operating holes formed at the manhole cover 20. In general, such operating holes each are generally arranged in the circumferential direction of a manhole cover. For clarity in the description, in FIG. 1, a single manhole cover 20 is provided with all kinds of operating holes 22*a* to 22*f*. Normally, one or two such types of operating holes are selectively provided at a manhole cover depending upon the type of a manhole cover. Operating holes as designated by reference numerals 22*a* and 22*b* in FIG. 1 are of the type defined by British Standard. The operating holes 22*a* and 22*b* each are formed to have a central circular portion and a pair of extensions outwardly radially extending in the opposite directions therefrom, so that such a hanging hook as generally indicated by reference numeral 24 in FIG. 1 which is constructed to have projections 26 provided on both sides of a lower end thereof may be fittedly engaged at the lower portion thereof therein. The operating holes 22*a* and 22*b* are formed in the directions perpendicular to each other along the circumference of the manhole cover 20.

An operating hole of such type as indicated by reference numeral 22*c* comprises a blind hole portion having a round bottom and a rectangular planar shape and a rod portion provided in a manner to be laid across the blind hole portion to separate the surface of the blind hole portion into two sections, so that such a hanging hook as generally designated by reference numeral 28 in FIG. 1 may be engaged with the operating hole 22*c* in a manner such that a hook portion 30 of the hanging hook 28 is engaged with the rod portion of the operating hole 22*c* to scoop the manhole cover 20. The rod portion of the operating hole 22*c* is formed so as not to project from the surface of the manhole cover. Also, the rod portion is generally formed to be integral with the manhole cover. An operating hole 22*d* is of the so-called hatch-type and comprises a blind hole portion and a handle provided in a manner to be retractable with respect to the manhole cover 20. The operating hole 22*d* likewise is used for a hanging hook of such type as indicated by reference numeral 28.

Operating holes indicated by reference numerals 22*e* and 22*f* in FIG. 1 each are of the so-called pick-hole type and typically provided at a cover for a manhole for water supply and drainage, a telephone line or the like in the United States. Such operating holes are formed into a simple circular or rectangular shape, in which a tip end of a pick is insertedly engaged to openably operate the manhole cover. The operating holes 22*e* and 22*f* are inferior in workability to those indicated by 22*a* to 22*d*.

In general, an apparatus for operating a manhole cover falls under the category of a portable tool, therefore, it has been conventionally required to restrict the overall length of the apparatus to at most about 1 m. This renders the use of the apparatus as a lever in such edge separating operation as described above highly troublesome or substantially impossible.

More particularly, the manhole cover edge separating operation, as shown in FIG. 2, requires lifting force of 1000 kg or more. In a typical manhole cover operating apparatus which has been conventionally used, operating holes each are provided at a position spaced inwardly by a distance of 8–10 cm from an outer periphery of the manhole cover. The maximum distance often mounts up to about 15 cm. Assuming that the lifting force of one operator is, for example, 60 kg and a manhole cover operating apparatus or lever which is used in the edge separating operation carried out under the above-noted circumstances has a length of, for example, 1 m and has a point of support positioned between a point of application and a point of force; the lifting of an edge of a manhole cover with force of 1000 kg in the edge separating operation requires the apparatus or lever to have a leverage of about 17. This requires the distance between a point of application and a point of support in the lever to be set at 5–6 cm. However, the setting of such a distance is substantially impossible because operating holes each are generally provided at a position spaced inwardly by a distance of 8–10 cm from an outer edge of a manhole cover, as described above.

Also, in order that the manhole cover of which the edge is lifted in such a manner as described above is removed and moved from a manhole, the manhole cover must be lifted by a distance sufficient to insert a roller between the ground and the cover, for example, a distance of about 10 cm. Unfortunately, in general, as the leverage of a lever is increased, the degree of lifting of a manhole cover is correspondingly reduced; accordingly, it is substantially impossible to carry out the movement of a manhole cover from a manhole subsequent to the edge separating operation.

Under the circumstances, in the operation of a manhole cover, the separation of an edge of a manhole cover securely adhered to a manhole by sand, mud or the like therefrom was carried out using not only a manhole cover operating apparatus but another means such as a hammer or the like, and the lifting and movement of the manhole cover from the manhole was carried out by means of separate special tools such as a lifter, a conveyor and the like as well as a manhole cover operating apparatus.

Such a conventional manhole cover operating apparatus as described above is exemplified in, for example, each of Japanese Patent Application Publication No. 46025/1978, Japanese Utility Model Application Laid-Open Publication No. 88452/1980 and Japanese Patent Application Laid-Open Publication No. 173227/1983. Unfortunately, the conventional manhole cover operating apparatus disclosed in the publications are limited to the use for only a manhole cover having operating holes of such type as defined in British Standard or indicated by reference numerals 22*a* and 22*b* in FIG. 1 and cannot be applied to operating holes of the pick-hole type as indicated by reference numeral 22*e* and 22*f* in FIG. 1. Also, the conventional apparatus each are directed to the movement of a manhole cover removed from a manhole and not suitable for use for the separating and lifting of an edge of a manhole cover from a manhole.

In view of the foregoing, the inventors proposed such a manhole cover operating apparatus as disclosed in Japanese Patent Application Publication No. 44505/1974. The apparatus disclosed is constructed to have a wheel incorporated therein which acts as a point of support to open a manhole cover. Unfortunately, the apparatus is applicable to only a manhole cover having two operating holes provided on its center-of-gravity line, for example, typically its diameter line and at a position near its outer periphery thereof, therefore, it is never used for a manhole cover locally provided with a single operating hole of the pick-hole type.

Accordingly, it would be highly desirable to develop an apparatus for operating a manhole cover which is capable of being applied to a manhole cover formed with operating holes of any shape or type and carrying out the separation of an edge of a manhole cover securely adhered to a support frame of a manhole therefrom and the lifting of the separated edge from the manhole as well as the movement of the manhole cover from the manhole.

SUMMARY OF THE INVENTION

In accordance with the present invention, an apparatus for operating a manhole cover is provided which comprises a lever-like body having a point of application, a point of support and a point of force defined thereon in order in the longitudinal direction thereof; and hanging hook means pivotally connected to the lever-like body through a pivot point defined on the side of the lever-like body acting as the point of application so as to be pivotally moved about the pivot point in the longitudinal direction of the lever-like body; the hanging hook means including an insertion which comprises a rod connected at one end thereof with respect to the pivot point of the lever-like body and inserted through an operating hole of the manhole cover and a projection provided at the other end of the rod to ensure the secure engagement between the insertion and the manhole cover therethrough, the projection being directed toward one side of the longitudinal direction of the lever-like body; the pivot point being defined so as to be eccentric to the side of the projection with respect to the longitudinal direction of the insertion of the hanging hook means; the point of support being defined at each of at least two positions spaced other on said lever-like body from each other in the longitudinal direction thereof.

In accordance with the present invention, there is also provided an apparatus for operating a manhole cover comprising a lever-like body formed into a substantially dog-leg shape and a point of application, a point of support and a point of force defined thereon in order in the longitudinal direction thereof; a support bracket mounted on the lever-like body so as to downwardly extend therefrom and positioned on the side thereof acting as the point of application, the support bracket having a pivot point defined at a lower end thereof; hanging hook means comprising an overhang arm pivotally connected at one end thereof to the pivot point of the support block so as to forwardly extend in the longitudinal direction of the lever-like body, a rod mounted at one end thereof on the other end of the overhang arm so as to downward extend thereof and inserted through an operating hole of the manhole cover, and a projection provided at the other end of the rod so as to direct toward the pivot point and engaged at the upper end thereof with a lower end of an operating hole of the manhole cover; the point of support being defined at each of two positions spaced from each other on the lever-like body in the longitudinal direction thereof, depending upon stages of the operation of the manhole cover; supporting means movably mounted on the lever-like body so as to be movable between the two positions of the point of support to support the apparatus during the operation of the manhole cover, the supporting means comprising a support bracket slidably mounted on the lever-like body in the longitudinal direction thereof and downwardly extending therefrom and a wheel means mounted at a lower end of the support bracket.

Accordingly, it is an object of the present invention is to provide an apparatus for operating a manhole cover which is capable of being applied to a manhole cover provided with an operating hole of any shape or type.

It is another object of the present invention to provide an apparatus for operating a manhole cover which is capable of accomplishing not only the separation of an edge of a manhole cover from a manhole but the lifting and movement of the manhole cover from the manhole.

It is a further object of the present invention to provide an apparatus for operating a manhole cover which is capable of carrying out the operation of swingably moving a manhole cover lifted from a manhole about pivot means such as a roller inserted between the lifted manhole cover and the ground.

It is still another object of the present invention to provide an apparatus for operating a manhole cover which is capable of readily setting a point of support for each of the separation of an edge of a manhole cover from a manhole and the movement of the manhole cover from the manhole.

It is yet another object of the present invention to provide an apparatus for operating a manhole cover which is carrying out the above-described objects with simple structure.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following detailed description taken in connection with the accompanying drawings in which like reference numerals designate like or corresponding parts throughout; wherein:

FIGS. 11A and 11B each are a side elevation view showing another manner of use of a manhole cover operating apparatus according to the present invention.

DETAILED DESCRIPTION OF THE PREFERRED EMBODIMENTS

Now, an apparatus for operating a manhole cover according to the present invention will be described hereinafter with reference to the accompanying drawings.

Figure 3:
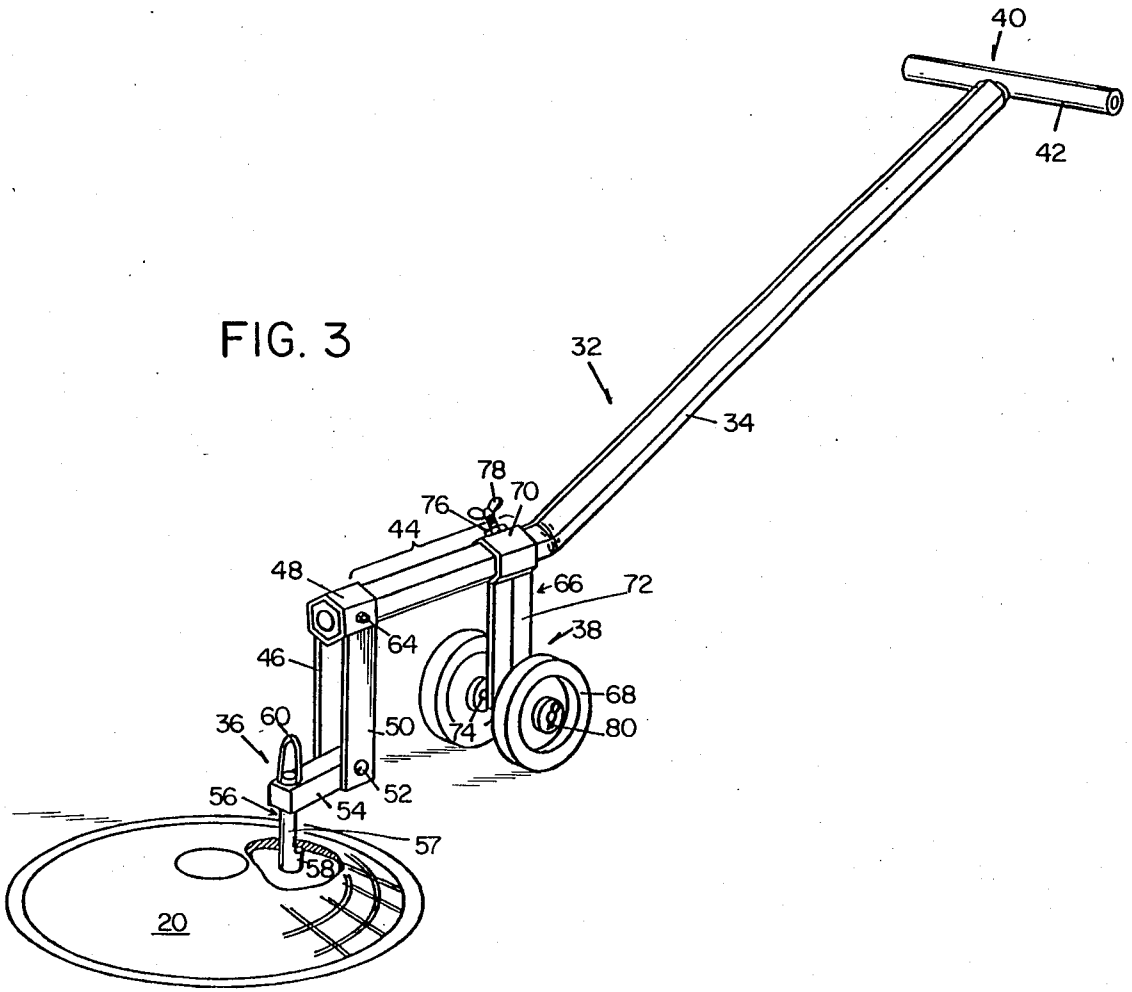
FIG. 3 is a perspective view showing an embodiment of an apparatus for operating a manhole cover according to the present invention.
Figure 4:
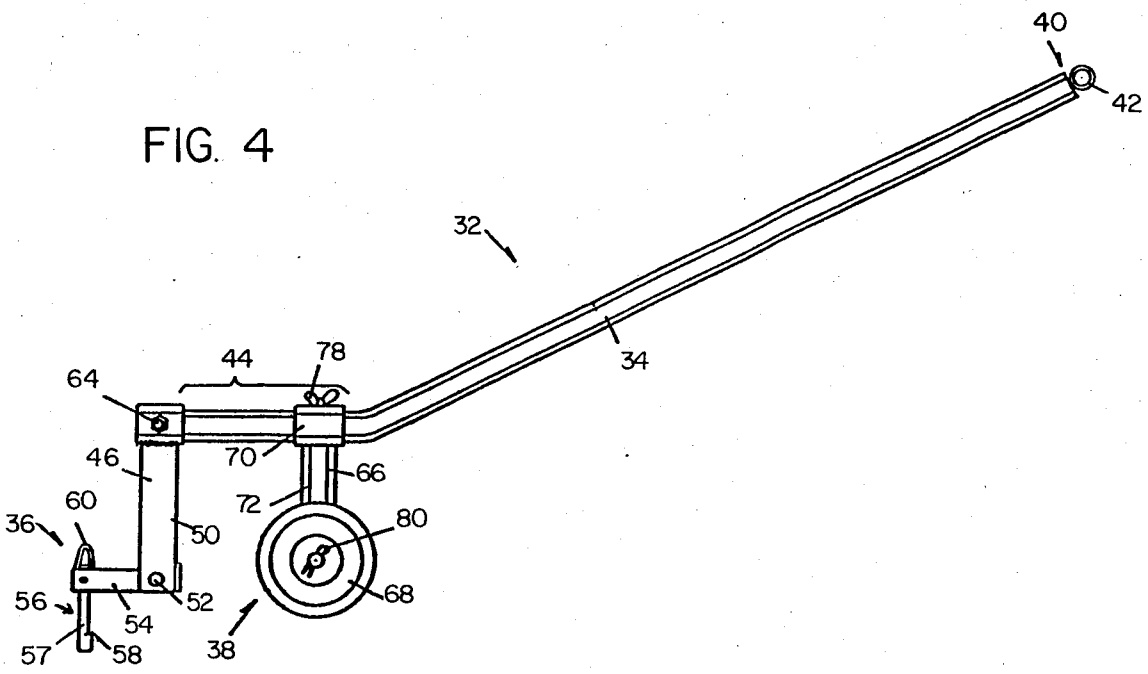
FIG. 4 is a side elevation view of the manhole cover operating apparatus shown in FIG. 1.

FIGS. 3 and 4 illustrate an embodiment of an apparatus for operating a manhole cover according to the present invention, wherein a manhole cover operating apparatus of the illustrated embodiment is generally designated by reference numeral 32. The operating apparatus 32 includes main components, i.e., a lever-like body 34, and hanging hook means and supporting means generally designated by reference numerals 36 and 38 in FIGS. 3 and 4, respectively.

The lever-like body 34 may comprise a rod-like member which is formed into a substantially dog-leg shape. In the illustrated embodiment, the lever-like body 34 is formed of a hollow steel pipe which is hexagonal in section and having a circular throughhole formed therein to extend in the longitudinal direction thereof. However, the lever-like body in the present invention is not limited to such a material and a shape, although the use of such a steel pipe is more convenient for the mounting of the supporting means 38 with respect to the lever-like body 34. For example, a pipe member of another shape in section such as a rectangular shape, a circular shape or the like may be conveniently used for the lever-like body 34. The only requirement for a material to be used for the lever-like body 34 is that it has a strength sufficient to endure the operation for operating a manhole cover 20. The lever-like body 34 has one end 40 acting as a point of force. For this purpose, the one end 40 of the lever-like body 34 has a handle 42 mounted thereon. The lever-like body 34 also has a fulcrum adjusting section 44 defined between the other end thereof and the bent portion thereof. The other end of the lever-like body 34 acts as a point of application and, for this purpose, a support bracket 46 is mounted on the other end of the body 34. In the illustrated embodiment, the support bracket 46 comprises a hollow fixing member 48 of a hexagonal shape fitted on the other end of the lever-like body 34 and two leg members 50 downwardly extending in parallel with each other from the fixing member 48.

Figure 1:
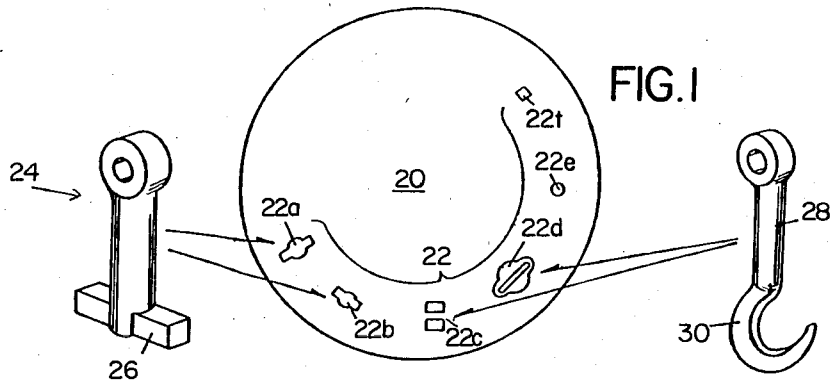
FIG. 1 is a schematic view illustrating a manhole cover provided with various kinds of operating holes and hanging hooks suitable for the engagement with the operating holes.
Figure 2:
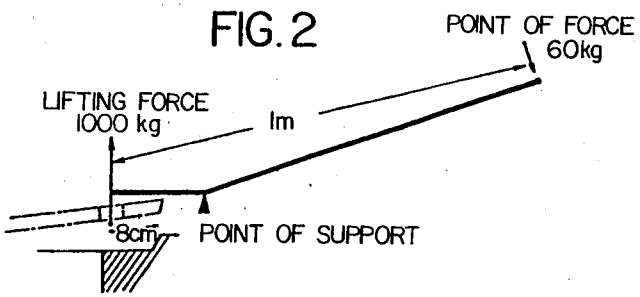
FIG. 2 is a diagrammatic view showing the action of a lever during the operation of opening a manhole cover.

The above-described hanging hook means 36 is rotatably fixed between lower ends of the leg members 50 through a pivot pin 52 acting as a pivot point. The hanging hook means 36 is generally formed into a substantially L-shape and comprises an overhang arm 54 of which one end is connected to the lower end of the support bracket 46 through the pivot pin 52 so as to forwardly extend or overhang in the longitudinal direction of the lever-like body 34 and a rod-like insertion member 56 connected to the other end or free end of the overhang arm 54 so as to downwardly extend therefrom. The rod-like insertion member 56 comprises a rod portion 57 and a projection portion 58 provided at the lower end of the rod portion 57 so as to project therefrom direct toward the pivot pin 52. In the illustrated embodiment, the insertion member 56 is formed to have dimensions sufficient to allow the whole rod portion 57 and projection portion 58 to be inserted into an operating hole of the pick-hole type as indicated by reference numeral 22*e* or 22*f* in FIG. 1, so that the insertion member 56 may be inserted into any type of an operating hole of a manhole cover.

Figure 5:
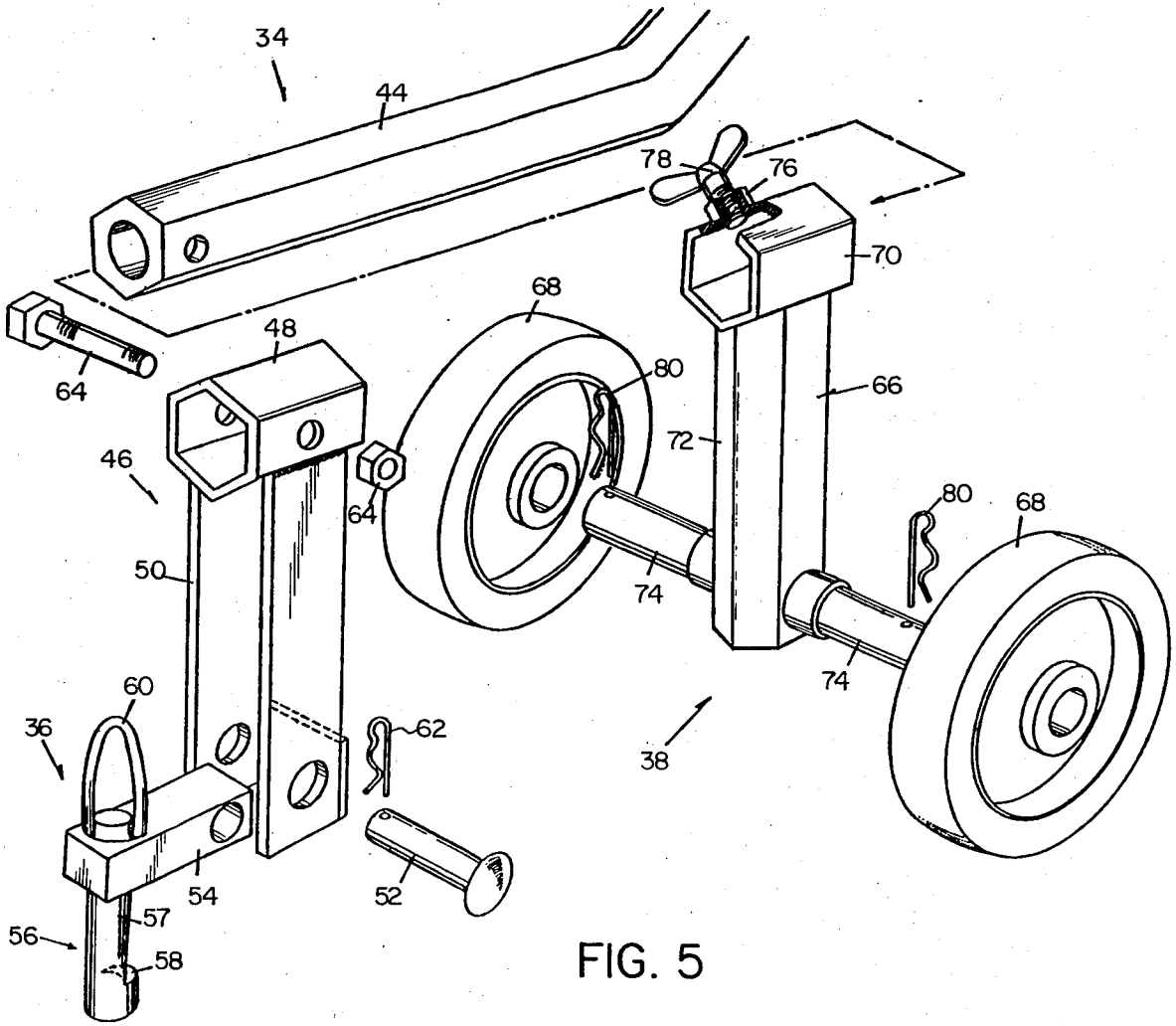
FIG. 5 is an exploded perspective view showing hanging hook means and supporting means of the manhole cover operating apparatus shown in FIG. 1.
Figure 6:
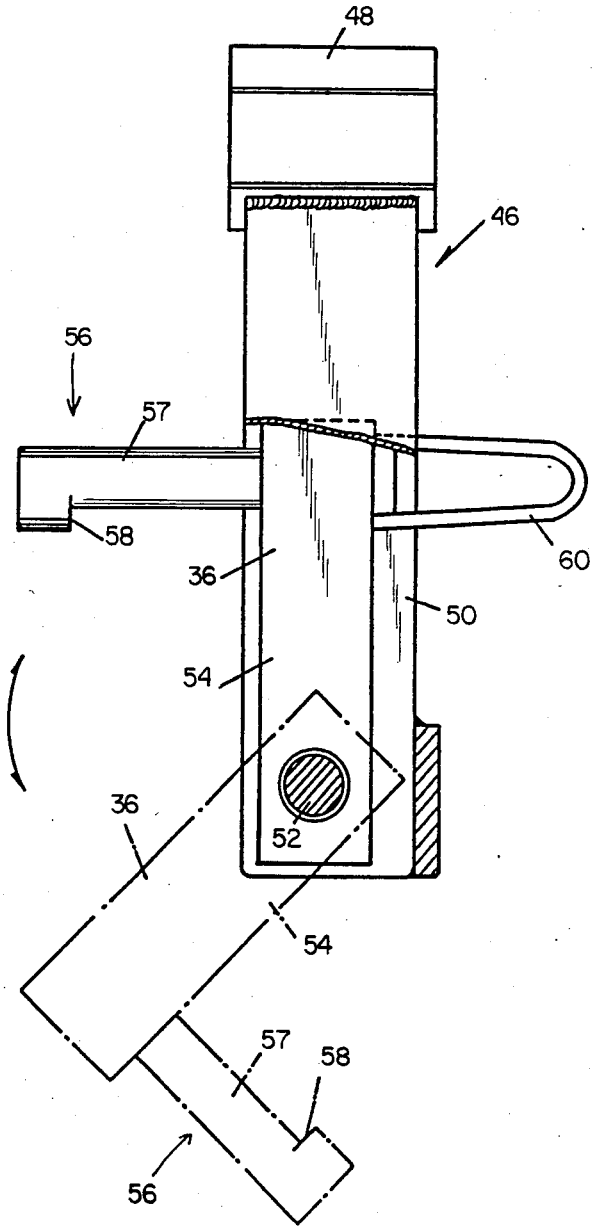
FIG. 6 is a side elevation view showing the operation of the essential part of hanging hook means.

In the illustrated embodiment, the hanging hook means 36 is constructed in the manner as described above, however, it is a matter of course that it is not limited to such construction. It may be constructed in another suitable manner so long as it is possible to arrange the pivot pin 52 or pivot point at a position eccentric with respect to the center of the insertion member 56 in the longitudinal direction thereof. In the illustrated embodiment, the insertion member 56 may be detachably connected to the overhang arm. Reference numeral 60 designates a hook for facilitating such handling of the insertion member 56. For example, the hook 60 may be used for such replacement of the insertion member 56. Reference numeral 62 (FIG. 5) indicates a stopper pin for preventing the pivot pin 52 from being disengaged from the leg members 50. As can be seen from the foregoing, the hanging hook means 36 is adapted to be rotatably or pivotally moved about the lower portion of the support bracket 46 or the pivot pin 52. Such pivotal movement of the hanging hook means 36 allows the overhang arm 54 to be inserted between the leg members 50 of the support bracket 46 as indicated by solid lines in FIG. 4 when it is upwardly moved or rotated toward the fixing member 48 of the support bracket 46 and be at such a position as indicated by phantom lines in FIG. 6 when it is downwardly rotated, so that it may be rotated at an angle of about 140 degrees.

In the illustrated embodiment, the hanging hook means 36, as described above, is attached through the support bracket 46 to the lever-like body 34, and the support bracket 46 is securely mounted on the lever-like body 34 by fixing the fixing member 48 to the lever-like body 34 by means of a bolt and nut assembly 64 inserted via through-holes formed at the lever-like body 34 and fixing member 48, so that the support bracket 46 may be dismounted from the lever-like body 34 by the removal of the bolt and nut assembly 64 from the connection between the lever-like body and the fixing member 48. However, the fixing of the support bracket 46 on the lever-like body 34 may be carried out by another suitable means such as welding or the like.

Now, the supporting means 38 will be described hereinafter.

The supporting means 38 comprises a support bracket 66 mounted at the upper end thereof on the lever-like body 34 and a pair of wheels 68 rotatably mounted on a lower end of the support bracket 66. More particularly, in the illustrated embodiment, the support bracket 66, as more detailedly shown in FIG. 5, comprises a hollow fixing member 70 of a hexagonal shape which is fitted on the lever-like body 34, a leg member 72 downwardly extending from the fixing member 70 and an axle 74 mounted on the a lower end of the leg member 72 so as to extend therethrough in the direction perpendicular to the longitudinal direction of the lever-like body 34. The fixing member 70 is formed at a part thereof with a threaded hole 76, with which a lock bolt 78 is threadedly engaged to accomplish the fixing between the fixing member 70 and the lever-like body 34. In the illustrated embodiment, the fixing member 70 is slidably fitted on the lever-like body 34, so that the loosening of the lock bolt 78 may allow the supporting means 38 to be moved on the lever-like body in the longitudinal direction thereof; however, because the fixing member 70 is formed into a hexagonal shape, it is ensured that the fixing member 70 is prevented from being rotated about the lever-like body 34 even when the lock bolt is loosened. Accordingly, when the lever-like body 34 is formed of a material circular in section, the body 34 is preferably formed with a suitable rotation preventing means such as a key way.

The wheels 68 are rotatably mounted on both ends of the axle 74 mounted on the lower end of the support bracket 66. The wheels 68 each are prevented from being disengaged from the axle 74 by means of a stop pin 80 inserted through the end thereof. The illustrated embodiment employs two such wheels. Instead, a single roller-like wheel of a much larger width may be used. Such a rotating wheel means is convenient to the movement of the manhole cover operating apparatus of the illustrated embodiment and facilitates the operation the manhole cover 20. However, the present invention is not limited to such a rotating wheel means as described above. For example, a simple projection-like base member may be substituted for the rotating wheel means.

Figure 7A:
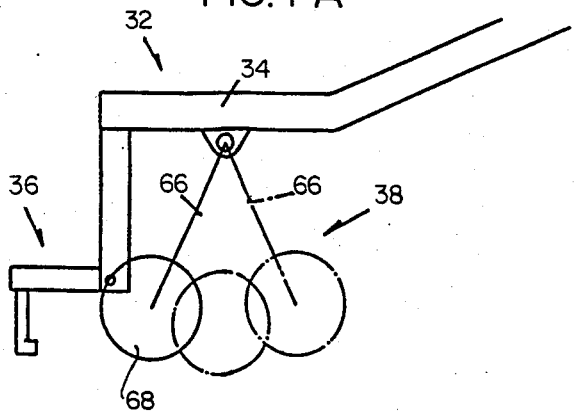
FIG. 7A is a schematic view showing a modification of supporting means.
Figure 7B:
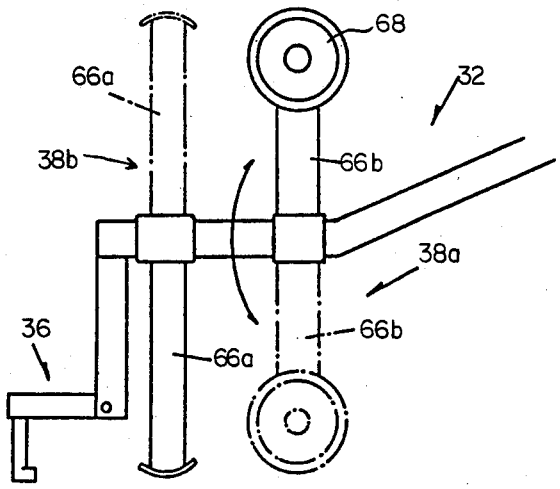
FIG. 7B is a schematic view showing another modification of supporting means.

In the illustrated embodiment, it is essential that the position at which the supporting means 38 is set with respect to the lever-like body 34 is adjustable. The construction for allowing the supporting means 38 to be adjustably set with respect to the body 34 is not limited to that described above. For example, the embodiment, as shown in FIG. 7A, may be modified in such a manner that the support bracket 66 is mounted on the lever-like body 34 so as to be swingable in the longitudinal direction of the lever-like body, so that the wheels 68 may be positionally adjustable with respect to the lever-like body 34. Also, such adjustable setting of the supporting means 38 is carried out at least twice in the operation a manhole cover or at the time of separating and lifting of an edge of the manhole cover from a manhole and at the time of moving the manhole cover from the manhole. Accordingly, the embodiment may be modified in such a manner as shown in FIG. 7B. More particularly, In FIG. 7B, two supporting means **38*a* and 38*b* are rotatably fitted on the lever-like body 34 at two positions spaced on the lever-like body from each other in the longitudinal direction thereof, so that one supporting means 38*a* or 38*b* may be laterally or upwardly retracted when the other is used for supporting the apparatus. Thus, it will be noted that, in the present invention, it is essential that the supporting means 38 is positionally adjustable between at least two positions with respect to the lever-like body 34**.

Figure 8:
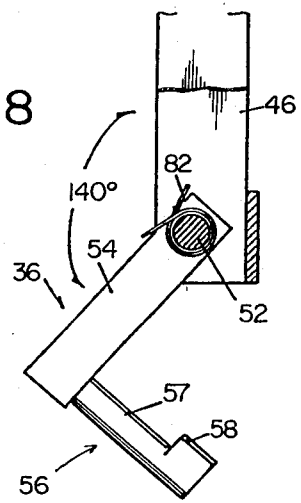
FIG. 8 is a side elevation view showing a modification of hanging hook means.

Further, the hanging hook means 36 may be modified in such a manner as shown in FIG. 8. In the operation of the apparatus of the illustrated embodiment, the hanging hook means 36 is so operated that when the insertion member 56 is inserted through an operating hole of a manhole cover, the hanging hook means 36 is inclined due to the weight of the overhang arm 54 to cause the projection portion 58 to be engaged with the lower end of the operating hole. The modification shown in FIG. 8 is constructed to more effectively ensure such movement of the hanging hook means. More particularly, for this purpose, a set spring 82 is interposedly arranged between the arm 54 and the support bracket 46 at the position of the pivot pin 52, resulting in the overhang arm 54 being forwardly inclined in advance at an angle of about 140 degrees with respect to the leg members 50.

Now, the manner of operation of the manhole cover operating apparatus of the illustrated embodiment constructed in the manner as described above will be described hereinafter with reference to FIGS. 9 to 12.

The manhole cover operating apparatus of the illustrated embodiment is adapted to successively carry out the operation of separating a manhole cover from a manhole, the operation of lifting the separated manhole cover from the manhole and the operation of moving the lifted manhole cover from the manhole, as follows:

1. Separation of edge of manhole cover from manhole:

In the operation of an edge of a manhole cover from a manhole, it is initially required to somewhat raise an edge of a manhole cover 30 from a manhole. Force for required for this purpose is about 1000 kg. This may be carried out according to the following procedures.

Figure 12:
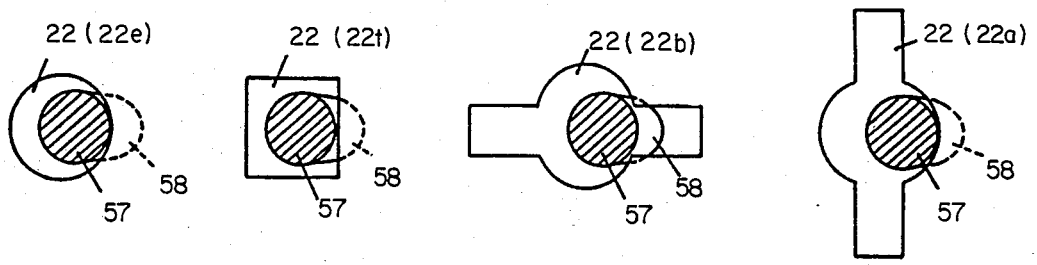
FIG. 12 is a schematic plan view showing the engagement between an operating hole of a manhole cover and hanging hook means of a manhole cover operating apparatus according to the present invention.
Figure 9A:
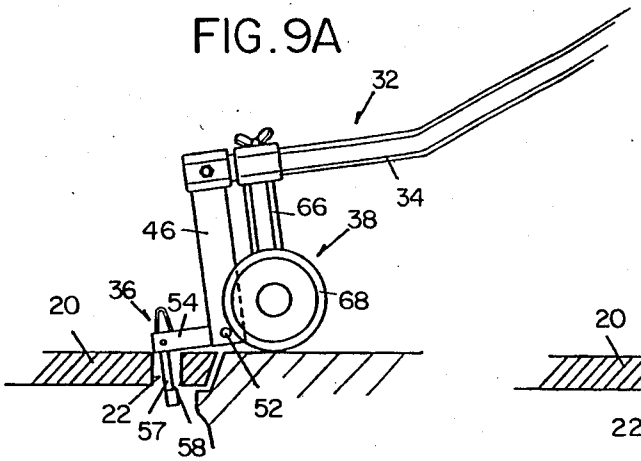
FIGS. 9A to 9C are side elevation views showing procedures in the operation of separating the edge of a manhole cover from a manhole in order.

First, the lock bolt 78 through which the support bracket 66 is fixed to the lever-like body 34 is loosened and then the support bracket 66 is substantially moved toward the hanging hook means 36 to highly increase the leverage of the lever-like body 34. Subsequently, the insertion member 56 of the hanging hook means 36 is inserted into an operating hole 22 of a manhole cover 20 as shown in FIG. 9A. In general, a manhole cover, as described above, is formed with various types of operating holes. In the illustrated embodiment, as described above, the insertion member 56 is formed to have dimensions sufficient to allow the whole rod portion 57 and projection portion 58 to be inserted into an operating hole of the pick-hole type as indicated by reference numeral 22*e* or 22*f* in FIG. 1, so that the insertion member 56 may be inserted into any type of an operating hole 22 as shown in FIG. 12.

When the insertion member 56 of the hanging hook means 36 is set in the operating hole 22 of the manhole cover 20 in this manner, the hanging hook means 36 is downwardly moved at the forward portion thereof due to its weight, so that the insertion member 56 may be engaged at the upper end of the projection portion 58 with the lower end surface of the operating hole 22 to ensure the secure engagement between the hanging hook means 36 and the manhole cover 20. Thus, an operator can operate the manhole cover operating apparatus 32 in a manner to downwardly move the handle 42 mounted on the one end of the lever-like body 34. This results in the lever-like body being so actuated that the lower end of the supporting means 38 or the wheels 68 act as a point of support to draw up the hanging hook means 36 acting as a point of application, as shown in FIG. 9A.

Figure 9B:
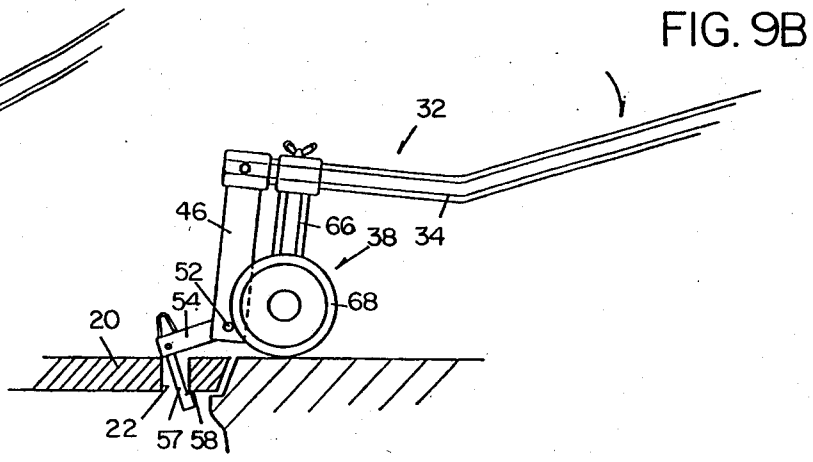
Figure 9C:
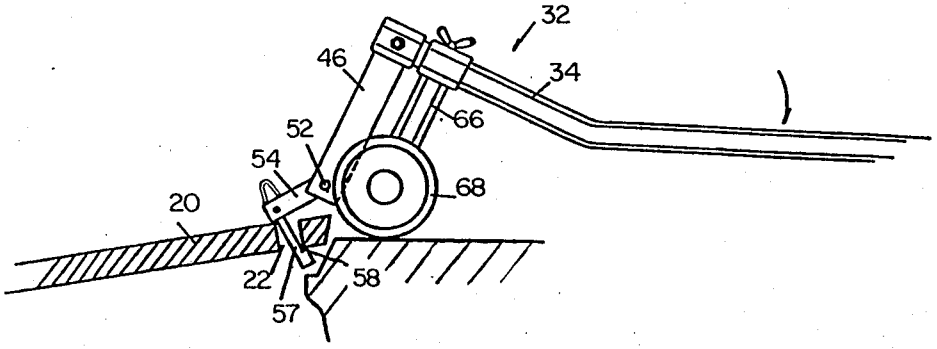

With the drawing-up of the hanging hook means 36, the support bracket 46 carries out the lifting of the hanging hook means 36 about the pivot pin 52. At this time, the insertion member 56 is caused to be inclined with respect to the axial direction of the operating hole 22 as shown in FIG. 9B, because the axis of the insertion member 56 inserted into the operating hole 22 is eccentric with respect to the pivot pin 52. This causes the outer surface of the rod portion 57 of the insertion member 56 or the surface thereof opposite to that having the projection portion 58 formed thereon to be forced against the upper portion of the operating hole 22 and therefore the upper end of the projection portions 58 to be engaged with the lower end of the operating hole 22, as shown in FIG. 9B. When the point of force or the one end 40 of the lever-like body 34 is further downwardly moved while keeping this state, the insertion member 56 acts to draw up a part of the edge of the manhole cover 20 at which the operating hole 22 is provided while further ensuring the engagement between the projection portion 58 of the insertion member 56 and the operating hole 22 of the manhole cover 20, due to an increase in leverage of the lever-like body 34 which is caused due to the eccentricity of the pivot pin 52 acting as the essential point of application; so that the manhole cover 20 may be released from the fixing or adhesion with respect to the manhole, resulting in the separation of the edge of the manhole cover 20 from the manhole being accomplished, as shown in FIG. 9C.

The illustrated embodiment effectively carries out the above-described manhole cover separating operation even when the operating hole 22 is provided apart from the outer periphery of the manhole cover 20. This is due to the fact that, in the illustrated embodiment, the distance between the point of application and the point of support at the time of the manhole cover separating operation can be substantially decreased, for example, to 5 cm or less, because it is possible to positionally determine the pivot pin 52 acting as the point of application in close proximity to the peripheral edge of the manhole cover 20 or, in case of extremity, above a support frame of the manhole depending upon the length of the overhang arm 54 and further it is possible to set the point of support substantially aside to the point of application. This results in the leverage of the lever-like body 34 to be highly increased to a degree sufficient to ensure the more rigid engagement between the hanging hook means and the manhole cover and exhibit large force required to separate the edge of the manhole cover from the manhole.

2. Drawing-up of manhole cover from manhole

Figure 10A:
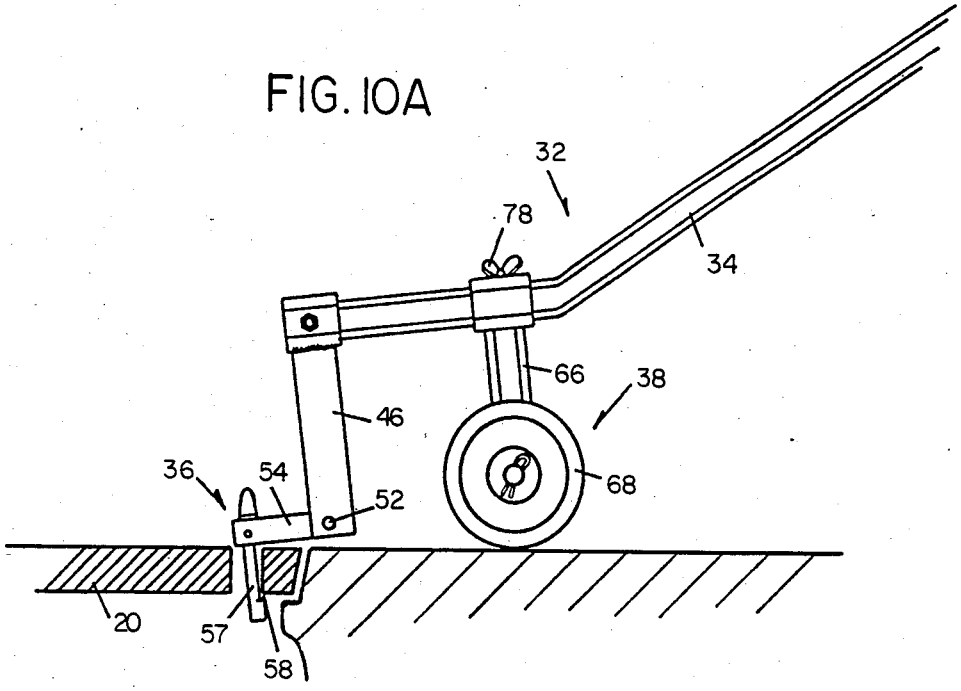
FIGS. 10A and 10B are side elevation views showing procedures in the operation of lifting a manhole cover from a manhole.
Figure 10B:
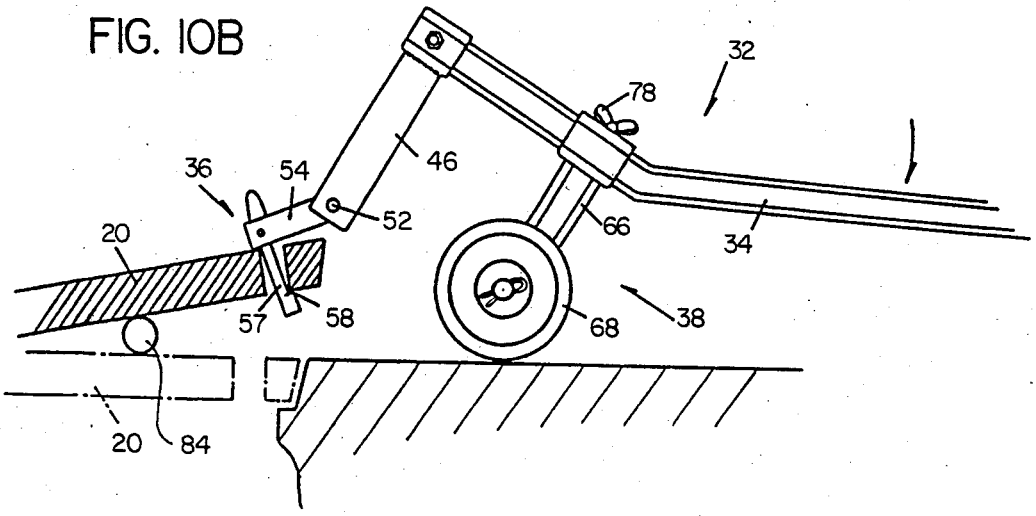

Now, the manner of operation of drawing up or lifting the so-separated manhole cover and inserting a roller under the manhole cover will be described hereinafter with reference to FIGS. 10A and 10B.

The lifting or operation is to lift one side of the manhole cover 20 which was separated from the manhole in the manner described above. Accordingly, force required for the operation is only about one half as much as the weight of the manhole cover. Thus, an increase in the leverage of the lever-like body 34 is not required as compared with that in the edge separation operation. Instead, it is required to lift the point of application in the apparatus to a raised position.

First, the insertion member 56 of the hanging hook means 36 is pulled out from the operating hole 22 of the manhole cover 20 separated from the manhole in the manner described above. Then, the lock bolt 78 which fixes the supporting means 38 with respect to the lever-like body 34 is loosened, and then the support bracket 66 is slidedly moved on the lever-like body 34 in the right direction to cause the supporting means 38 to be transferred to the portion of the fulcrum adjusting section 44 closest to the point of force, as shown in FIG. 10A, so that the leverage of the lever-like body 34 may be decreased. Subsequently, the insertion member 56 of the lever-like body 34 is inserted into the operating hole 22 of the manhole cover 20 as shown in FIG. 10A. Then, the handle 42 acting as the point of force is downward pushed in a manner similar to that in the edge separating operation, so that the hanging hook means 36 may lift one end of the manhole cover at which the operating hole is provided 20 to a raised position as shown in FIG. 10B. Upon lifting of the manhole cover 20, a roller 84 is inserted between the raised manhole cover 20 and the ground, and then the manhole cover is carried on the roller 84 and moved from the manhole by means of the handle 42.

3. Movement of manhole cover from manhole by inversion

When any obstacle such as a projection is formed on the rear surface of the manhole cover lifted from the manhole in the manner described above, the manhole cover moving operation in the above-described manner is rendered difficult or impossible. In this instance, the operation may be carried out in such a manner as shown in FIGS. 11A and 11B, as follows:

(1) Operation of pushing down manhole cover

The operation is to insert another roller under the opposite side of the manhole cover which is not still raised, after the roller 84 has been inserted beneath the one side thereof in the manner described above. This is effective in the case that the manhole cover is formed on a lower surface thereof with an obstacle such as a projection or the like.

First, the hanging hook means 36 is pivotally moved to substantially cause the arm 54 to be aligned with the leg members 50 of the support bracket 46. This causes the insertion member 56 of hanging hook means 36 to be projected from the support bracket 46 in the direction perpendicular thereto. The operation is carried out using the manhole cover operating apparatus deformed into such configuration to lift the other side of the manhole cover using the roller 84 inserted under the one end side thereof by the above-described lifting operation as a point of support.

For this purpose, the apparatus 32 is first caused to fall forward to direct the leg members 50 of the hanging hook means 36 toward the manhole cover and position the other end of the lever-like body 34 opposite to the one end side of the manhole cover, as shown in FIG. 11A, and then the insertion member 56 is inserted into the operating hole 22 of the manhole cover 20. During the operation, the supporting means 38 is not used. Accordingly, the position of the supporting means 4 does not affect the operation. Then, the handle 42 (not shown) of the lever-like body 34 acting as the point of force is rotated in the direction of lifting the manhole cover. In FIG. 11A, this is the clockwise direction. This causes the other end or tip end of the lever-like body 34 abutting against the manhole cover 20 to act as a point of support to substantially upwardly move the tip end portion of the support bracket 46 at which the pivot pin 52 is arranged, so that the insertion member 56 inserted into the operating hole 22 of the manhole cover 20 may be inclined in the operating hole 22. This results in the projection portion 58 of the insertion member 56 being securely engaged with the lower end of the operating hole 22. Subsequently, when the handle 42 is further rotated in the same direction, the other end of lever-like body 34 or the support bracket 46 acts to push down the one end side of the manhole cover 20 raised by the roller 84, so that the other end side of the manhole cover 20 may be substantially raised about the roller 84. Thereafter, at least one additional roller is inserted under the newly raised end side of the manhole cover 20, so that it may be ready to be moved on the rollers away from the manhole.

(2) Operation of lifting manhole cover

The operation (1) described above is adapted to push down the operating hole side of the manhole cover 20. On the contrary, the present operation, as shown in FIG. 11B, is to push up the operating hole side of the manhole cover 20. For this purpose, the apparatus 32 is positioned with respect to the manhole cover 20 in the direction opposite to that shown in FIG. 11A. More particularly, the apparatus 32 is so positioned that the lever-like body 34 is directed toward the roller 84 and the insertion member 56 is then inserted into the operating hole 22 of the manhole cover 20. Then, the apparatus is rotated through the handle 42 mounted on the one end of the lever-like body 34 about the other end or tip end of the body 34 in the direction opposite to that in FIG. 11A or the counterclockwise direction in FIG. 11B, so that the tip end portion of the support bracket 46 at which the pivot pin 52 is mounted may be upward moved. This causes the overhang arm 54 to be inclined so that the one end thereof connected to the pivot pin 52 may be upwardly moved. Concurrently, this also causes the insertion member 56 to be inclined, resulting in the projection portion 58 of the insertion member 56 being firmly engaged at the upper end thereof with the lower end of the operating hole 22 as shown in FIG. 11B, so that the rigid engagement between the hanging hook means 36 and manhole cover 20. Subsequently, when the lever-like body 34 of the apparatus 32 is further rotated in the same direction, force required to raise the operating hole side of the manhole cover 20 about the roller 84 is applied to the manhole cover, resulting in the the operating hole side of the manhole cover being lifted.

The insertion of the roller 84 under the manhole cover 20 may be carried out according to the above-described procedures. Alternatively, when the manhole cover 20 is provided with two operating holes at the positions along the periphery thereof and diametrically opposite to each other, one operating hole side of the manhole cover is first lifted to insert one roller thereunder and the other operating hole side is then lifted according to the procedures of Item 2 described above to insert another roller thereunder.

4. Closing of manhole with manhole cover

In general, the manhole cover removed from the manhole in the manner described above is put in the vicinity of the manhole while keeping at least one roller under the manhole cover, until the manhole operation is completed. The operation of returning the manhole cover to the manhole after the manhole operation is carried out by somewhat pushing down the one end side of the manhole cover on which the operating hole 22 is provided in such a manner as shown in FIG. 11A and drawing the manhole cover into the manhole while at least one of the rollers 84 under the manhole cover. Such manhole cover returning operation may be carried out in an opposite manner or in such a manner as shown in FIG. 11B. In the manhole cover returning operation, it is essential to utilize the roller to move the manhole cover to the manhole, to thereby fit any one side of the manhole cover in a support frame of the manhole cover . Thereafter, the roller 84 is removed from the manhole cover 20 while lifting the manhole cover according to the procedures described above in connection with FIG. 10, and the handle 42 of the lever-like body 34 is released from force downwardly applied thereto to fit the whole manhole cover in the manhole.

As can be seen from the foregoing, the present invention is adapted to carry out both the separation of an edge of a heavy manhole cover adhered to a manhole therefrom and the removal of the manhole cover therefrom with ease and much less force, so that a decrease in labor and safety in the operation operation may be ensured to highly reduce the generation of labor accident. Also, the present invention is effectively applicable to a manhole cover formed with operating holes of the pick-type as well, so that the operation of a manhole cover provided with various types of operating holes may be readily and positively accomplished.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An apparatus for operating a manhole cover, comprising:

a lever-like body having a point of application, a point of support and a point of force defined thereon in order in the longitudinal direction thereof; and hanging hook means pivotally connected to said lever-like body through a pivot point defined on the side of said lever-like body acting as said point of application so as to be pivotal about said pivot point in the longitudinal direction of said lever-like body;

said hanging hook means including an insertion member which comprises a rod connected at one end thereof with respect to said pivot point of said lever-like body and inserted through an operating hole of the manhole cover and a projection provided at the other end of said rod to ensure the firm engagement between said insertion member and the manhole cover therethrough;

said pivot point being offset with respect to the longitudinal direction of said insertion member of said hanging hook means;

said point of support being defined at each of at least two positions spaced on said lever-like body from each other in the longitudinal direction thereof;

wherein means for presetting the angular position of said hanging hook means with respect to said lever-like body are arranged between said hanging hock means and said lever-like body.

2. An apparatus as defined in claim 1, wherein said lever-like body is generally formed into a substantially dog-leg shape.

3. An apparatus as defined in claim 2, wherein said lever-like body is formed of an elongated hollow rod of a substantially hexagonal shape.

4. An apparatus as defined in claim 3, wherein said lever-like body is formed of metal.

5. An apparatus as defined in claim 1, further comprising supporting means movably mounted at one end thereof on said lever-like body so as to downwardly extend therefrom and be movable between said points of support defined at said two positions.

6. An apparatus as defined in claim 1, further comprising supporting means swingably fixed at an upper end thereof on said lever-like body so that a lower end of said supporting means may be swingably moved between said points of support defined at said two positions.

7. An apparatus as defined in claim 1, further comprising supporting means stationarily mounted at one end thereof on each of said points of support defined at said two portions of said lever-like body so as to be rotatable about said lever-like body.

8. An apparatus as defined in claim 5, wherein said supporting means comprises a support bracket mounted at one end thereof on said lever-like body so as to downwardly extend therefrom and wheel means mounted on the other end of said support bracket.

9. An apparatus for operating a manhole cover, comprising:

a lever-like body having a point of application, a point of support and a point of force defined thereon in order in the longitudinal direction thereof; and hanging hook means pivotally connected to said lever-like body through a pivot point defined on the side of said lever-like body acting as said point of application so as to be pivotal about said pivot point in the longitudinal direction of said lever-like body;

said hanging hook means including an insertion member which comprises a rod connected at one end thereof with respect to said pivot point of said lever-like body and inserted through an operating hole of the manhole cover and a projection provided at the other end of said rod to ensure the firm engagement between said insertion member and the manhole cover therethrough;

said pivot point being offset with respect to the longitudinal direction of said insertion member of said hanging hook means;

said point of support being defined at each of at least two positions spaced on said lever-like body from each other in the longitudinal direction thereof;

said hanging hook means being pivotally connected to said lever-like body through a support bracket which is mounted on said lever-like body so as to downwardly extend therefrom;

said pivot point being positioned at a lower end of said support bracket;

said hanging hook means also including an overhang arm pivotally connected at one end thereof through said pivot point to said lever-like body in a manner to forwardly project therefrom in the longitudinal direction of said lever-like body;

said insertion member of said hanging hook means being mounted at one end thereof on the other end of said overhang arm so that said hanging hook means are generally formed into a substantially L-shape;

said hanging hook means being arranged to be rotatable between a first position at which said overhang arm overlaps said support bracket and a second position forwardly spaced by an angle of about 140 degrees from said first position in the longitudinal direction of said lever-like body.

10. An apparatus as defined in claim 9, wherein said insertion member of said hanging hook means is detachably mounted with respect to said hanging hook means.

11. An apparatus as defined in claim 9, wherein said projection of said insertion member is engagable at an upper end thereof with a lower end of the manhole cover.

12. An apparatus as defined in claim 9, wherein said support bracket comprises two leg members, said hanging hook means being pivotally connected between said leg members.

13. An apparatus for operating a manhole cover comprising:

a lever-like body formed into a dog-leg shape and having a point of application, a point of support and a point of force defined thereon in order in the longitudinal direction thereof;

a support bracket mounted at an upper end thereof on said lever-like body so as to downwardly extend therefrom and positioned on the side of said lever-like body acting as said point of application, said support bracket having a pivot point defined at a lower end thereof;

hanging hook means comprising an overhang arm pivotally connected at one end thereof to said pivot point of said support bracket so as to forwardly extend in the longitudinal direction of said lever-like body, a rod mounted at one end thereof on the other end of said overhang arm so as to downwardly extend therefrom and be insertable through an operating hole of the manhole cover, and a projection provided at the other end of said rod directed toward said pivot point and engagable at the upper end thereof with a lower end of an operating hole of the manhole cover;

said point of support being defined at each of two positions spaced on said lever-like body from each other in the longitudinal direction thereof;

supporting means movably mounted on said lever-like body so as to be movable between said two positions of said point of support to support said apparatus during the operation of the manhole cover, said supporting means comprising a support bracket slidably mounted on said lever-like body so as to downwardly extend therefrom and wheel means mounted at a lower end of said support bracket.

* * * * *